US005686821A

United States Patent [19]

Brokaw

[11] Patent Number: 5,686,821

[45] Date of Patent: Nov. 11, 1997

[54] STABLE LOW DROPOUT VOLTAGE REGULATOR CONTROLLER

[75] Inventor: Adrian P. Brokaw, Burlington, Mass.

[73] Assignee: Analog Devices, Inc., Norwood, Mass.

[21] Appl. No.: 647,241

[22] Filed: May 9, 1996

[51] Int. Cl.[6] ..... G05F 1/575

[52] U.S. Cl. ..... 323/273; 323/280

[58] Field of Search ..... 323/273, 280, 323/277, 281, 313, 314, 315, 316

[56] References Cited

U.S. PATENT DOCUMENTS

| | | | |
|---|---|---|---|
| 4,636,710 | 1/1987 | Stanojevic | 323/280 |
| 4,902,959 | 2/1990 | Brokaw | 323/314 |
| 4,928,056 | 5/1990 | Pease | 323/314 |
| 5,274,323 | 12/1993 | Dobkin et al. | 323/280 |
| 5,394,078 | 2/1995 | Brokaw | 323/313 |
| 5,406,222 | 4/1995 | Brokaw | 330/257 |
| 5,467,009 | 11/1995 | McGlinchey | 323/269 |
| 5,563,501 | 10/1996 | Chan | 323/282 |

OTHER PUBLICATIONS

Paul Horowitz, Winfield Hill, *The Art of Electronics*, Cambridge University Press, New York, 1989, pp. 98–104, 345–349.

Walt Kester Ed., Linear Design Seminar, Analog Devices, Norwood, Massachusetts, 1991, pp. 8–2 through 8–18.

James E. Solomon, "The Monlithic Op Amp:A Tutorial Study", *IEEE Journal of Solid State Circuits*, vol. SC–9, Dec. 1974, pp. 314–332.

*Primary Examiner*—Adolf Berhane
*Attorney, Agent, or Firm*—Koppel & Jacobs

[57] ABSTRACT

A single-loop voltage regulator controller includes a high-gain transconductance amplifier that accommodates common mode inputs as low as its negative supply rail. The input stage of the amplifier produces a proportional to absoulte temperature (PTAT) input offset voltage. The transconductance amplifier's inverting input is connected to the circuit common, or negative supply rail, and a tap from a feedback network is connected to the amplifier's noninverting input. The feedback network provides, at this tap, a PTAT measure of the regulator's regulated output. The amplifier's output is connected to drive a noninverting driver which, in turn, is connected to drive the control terminal of the regulator's pass transistor. A compensation capacitor connected between the amplifier's output and the regulated output terminal ensures the regulator's stability even for relatively low level load impedances.

30 Claims, 6 Drawing Sheets

STABLE LOW DROPOUT VOLTAGE REGULATOR CONTROLLER

BACKGROUND OF THE INVENTION

1. Field of the Invention

The invention is related to voltage regulators and, in particular, to "low drop-out" voltage regulators.

2. Description of the Related Art

Voltage regulators play a critical role in the proper operation of nearly all electronic circuits. It would be virtually impossible to produce and operate the vast array of electronic systems: consumer and military, scientific and commercial, entertainment and business, that are woven throughout the fabric of modern technological society in the absence of integrated circuit voltage regulators.

Low dropout voltage regulators produce a regulated output voltage even when the unregulated input voltage from a power source falls to a level very near that of the regulated output voltage. Because power dissipated by the regulator's pass element is proportional to the voltage drop across the pass element, and because battery voltages typically fall as batteries are discharged, battery-powered electronic systems commonly employ low dropout regulators, but their use is by no means limited to battery-powered systems. Low dropout voltage regulators are known in the art. For a more detailed discussion see Paul Horowitz, Winfield Hill, *The Art of Electronics,* Cambridge University Press, 1989, pages 345–349.

A conventional voltage regulator 10 illustrated in block diagram form in FIG. 1 includes a pass transistor 12 connected at its current conducting terminals 14 and 16 to an unregulated input voltage terminal VIN and a regulated voltage output terminal VREG, respectively. The unregulated input VIN and regulated output voltages VREG are both referenced to a common voltage, labeled COMMON, that may itself be positive or negative relative to "ground". A feedback circuit 18 is connected from the regulated output VREG to the common terminal COMMON. The feedback circuit 18 provides, at its tap 20, a feedback signal indicative of the voltage appearing across the VREG/COMMON terminals. Power is supplied from the input terminal VIN to a voltage reference circuit 22 which provides a reference voltage at its tap 24. The reference voltage and feedback signal are coupled to the inverting and noninverting inputs, respectively, of an amplifier 26 which has its output connected to the control terminal 28 of the pass transistor 12. The amplifier/pass transistor pair form a high gain operational transconductance amplifier; a relatively small voltage difference across the amplifier's inputs yields a significant change in current output. This, of course, is what a voltage regulator "is all about": rapidly adjusting its output current to accommodate load variations and thereby maintain a prescribed output voltage.

The feedback circuit 18 may be implemented, for example, as a voltage divider formed by a pair of resistors. The voltage reference 22 may be any one of several types of voltage reference, but preferably includes temperature compensation circuitry. The feedback circuit 18 is designed so that the feedback signal appearing at the tap 20 equals the reference voltage when the regulated output voltage VREG equals the target value. Whenever VREG varies from the desired value, the comparator 26 adjusts the control signal at the transistor control terminal 28 to bring VREG back to the target value. The regulator supplies current to a load, represented in FIG. 1 by a parallel combination of a variable resistor RL and variable capacitor CL. As the load varies, the control circuit, including the reference and feedback loops, act as just described to keep the output voltage VREG at the target level. The capacitive load CL is also characterized by an equivalent series resistance ESR which may vary over time.

The schematic diagram of FIG. 2 illustrates a conventional low dropout regulator in greater detail. In this implementation the pass transistor 12 is a PNP bipolar transistor with its emitter 14 connected to a supply voltage VIN, its collector 16 providing the regulated output VREG, and its base acting as the control terminal 28. The PNP transistor 12 is capable of providing a regulated output voltage even when its collector-emitter voltage, i.e., the dropout voltage, falls to nearly the saturation voltage. In this way, a regulator employing a PNP transistor may provide regulation with a dropout voltage as low as a few hundred millivolts. This is in contrast to the nearly two volts of dropout voltage required for non-low dropout regulators.

Because zener voltage references tend to be noisy and typically do not provide low-voltage references, a more elaborate voltage reference, such as a bandgap reference, may be employed. One example of such a reference, sometimes referred to as a "Brokaw cell", is used as the reference 22 in this exemplary voltage regulator. For a more complete discussion of voltage references, see Walt Kester Ed., *Linear Design Seminar,* Analog Devices, Norwood, Mass., 1991 pgs 8-2 through 8-18 and U.S. Pat. No. 4,902,959 issued to the present applicant. This voltage reference includes an NPN transistor Q1 with its emitter coupled through a resistor R1 to COMMON, its base connected to the base of an NPN transistor Q2 and to the tap of a voltage divider formed from resistors R2 and R3, and its collector connected to the noninverting input of an operational amplifier 30. Its collector is also coupled through a load resistor R4 to the positive supply terminal VIN. Similarly, the transistor Q2 has its collector coupled to the positive supply terminal VIN through a load resistor R5 that is equal to the load resistor R4 and to the inverting input of the operational amplifier 30. The emitter of the transistor Q2 is coupled through a resistor R6 to the resistor R1 and to the emitter of transistor Q1. The emitters of transistors Q1 and Q2 are ratioed; in this example the emitter of the transistor Q2 has eight times the area of the emitter of the transistor Q1.

Keep in mind that this is an illustrative example designed to set forth general operational principles, and that a "real world" design may include additional circuitry, for example, to isolate the load resistors R4 and R5 from changes in the input votlage VIN. Since the load resistors R4 and R5 are equal and the operational amplifier 30 ensures that the voltage across R4 is substantially equal to that across R5, the currents I1 and I2 through R4 and R5, respectively and through the associated collectors of transistors Q1 and Q2, are equal. Equal collector currents create unequal current densities in the ratioed emitters of the transistors Q1 and Q2. With unequal current densities, the base-emitter voltages of the transistors Q1 and Q2 will be different and, since their bases are at the same potential, the difference in base-emitter voltage ($\Delta Vbe=(kT/q)\ln C$, where k is Boltzmann's constant, T is the temperature Kelvin, q is the electron charge and C is the ratio of current densities) will appear across the resistor R6. The current through the resistor R1=I1+I2, i.e., the sum of the collector currents, and I1=ΔVbe/R6. The voltage V1 across R1 is, therefore, a proportional to absolute temperature (PTAT) voltage:

$$V1=(2)(\Delta Vbe/R6)\ (R1)$$

The voltage Vbg appearing at the tap of the R2, R3 voltage divider is therefore:

$$Vbg = V1 + Vbe1 = (2)(\Delta Vbe/R6)(R1) + Vbe1$$

where:

Vbe1=the base/emitter voltage of transistor Q1

By setting the resistor values so that this sum is equal to the bandgap voltage, approximately 1.25 V for silicon, the temperature-dependent portion of the PTAT voltage ΔVbe is "canceled" by the temperature-dependent portion of the complementary to absolute temperature voltage (CTAT) Vbe1, yielding a reference voltage which is substantially independent of temperature. The ratio of resistors R2 and R3 determines the reference voltage output produced at the reference output 24. If, for example, the value of resistor R2 is three times that of R3, the reference voltage at terminal 24 will be approximately 5 V.

A feedback circuit 18 includes resistors R7 and R8 connected as a voltage divider across the VREG/COMMON terminals. The resistors R7 and R8 are chosen so that a voltage equal to the reference voltage at terminal 24 appears at the divider tap 20 whenever the output voltage VREG equals the desired output voltage. As described in relation to the discussion of FIG. 1, the comparator 26 compares the voltages presented to its inverting and noninverting inputs, from the reference and feedback loops, and adjusts the control terminal 28 of the pass transistor 12 to rapidly return these inputs to equality whenever they stray from one another. The regulator's load is once again represented by a parallel combination of a load capacitance CL and load resistance RL, and the load capacitance CL has an effective series resistance ESR associated with it. The load presented to the regulator may vary widely; subcircuits may be switched into or out of the load, the load may vary with temperature, or it may vary with the speed at which the circuit operates. Additionally, the load capacitor's ESR may increase significantly over time.

In addition to the more direct effect this variation in load has on the regulator, i.e., modulation of the pass transistor's control terminal, load variation may adversely affect the regulator's frequency stability. That is, as with other closed loop amplifiers, voltage regulators must be carefully designed to prevent excessive closed loop phase shift, which will lead to excessive phase shift and oscillation. Low drop-out regulators are particularly susceptible to oscillation due to their high open loop output impedance (presented by the collector of the pass transistor 12, in this example). System designers must exercise great care when using conventional low dropout regulators in order to avoid regions of instability (see, for example, data sheets for TPS7133QPWP, TPS7133Y micropower low drop-out regulators available from Texas Instruments, Dallas Tex.). Due to the difficulty of predicting variations in CL, RL and ESR, system designers face a daunting task when attempting to ensure the stability of conventional regulators within their systems.

Specifically, to ensure the stability of the regulator, the unity gain, or crossover, frequency of the transconductance amplifier should be kept well below frequencies associated with the poles of its frequency response. This may be accomplished with a large load capacitance and, because a large load capacitor is often employed to filter the regulator's output, this capacitor is often relied upon to ensure the regulator's stability. Although a large load capacitor establishes a pole of the regulator's frequency response at a low frequency, forcing the regulator circuit's gain to rolloff, as desired, at 6 dB/decade, the load capacitor's ESR creates a zero above which the frequency response is flat. If the ESR is greater than the reciprocal of the product of the transconductance gm and the voltage divider's attenuation factor, the zero occurs at a lower frequency than the desired crossover frequency, thus defeating the stabilizing effect of the load capacitor at higher frequencies and permitting the regulator circuit to oscillate. Some regulators employ a capacitor connected between the base and collector of the pass transistor to provide frequency stability. However, this couples high frequency noise and transients from the regulator's input to its output. Other frequency compensation schemes, especially for low dropout regulators, suffer from their own deficiencies.

Additionally, in order to operate more efficiently and to employ electronic devices with smaller and smaller feature sizes, electronics systems have increasingly migrated toward lower supply voltages. That is, there is an increasing demand for systems which operate from regulated output voltages that are less than the 5 V supply which was a standard for many years. Newer systems require regulated voltages of 3 V and lower. This leaves less and less "head room" for regulators, such as those of FIGS. 1 and 2, that employ a feedback controller 26 referenced to some multiple of 1.25 V.

Furthermore, as with the majority of electronic circuits, lower costs, higher reliability, and packaging advantages accrue to voltage regulators with simpler, more elegant designs. In particular, voltage regulators typically allot as much as half the space within their packages to the pass transistor. Any reduction in the area required for controller circuitry may be taken up by the pass transistor, yielding a regulator with power-handling capabilities that may otherwise require a larger package.

SUMMARY OF THE INVENTION

The invention is directed to a stable low dropout regulator controller that occupies less space than conventional regulator controllers with the same level of functionality and provides additional headroom for low-voltage applications.

The invention comprises a single-loop feedback controller that is connectable to the control terminal of a pass transistor in a manner that produces a substantially temperature independent regulated output voltage. Since the feedback controller is a single-loop controller, the number of components required may be less than required by prior art regulator controllers; consequently, a regulator that employs the controller may be more reliable, less expensive and may accommodate a smaller package size than a conventional two-loop feedback controller.

In a preferred embodiment, the controller includes a high-gain transconductance amplifier that accommodates common mode inputs as low as its negative supply rail. The input stage of the amplifier produces a PTAT input offset voltage. The transconductance amplifier's inverting input is connected to the circuit common, or negative supply rail, and a tap from a feedback network is connected to the amplifier's noninverting input. The feedback network provides, at this tap, a PTAT measure of the pass transistor's regulated output voltage. In this way, the regulator's reference, feedback, and comparator functions are all combined in a single amplifier/feedback loop. The amplifier's output is connected to drive a noninverting driver which, in turn, is connectable to drive the control terminal of a pass transistor. A compensation capacitor is connected between the amplifier's output and the regulated output terminal. This capacitor is chosen to ensure the regulator's stability and its placement actually counteracts, rather than exacerbates, the high-frequency feedthrough which plagues some conventional regulators.

The controller may be combined with a pass transistor to form a voltage regulator that is particularly suited to operation from low-voltage unregulated voltage sources such as batteries. Additionally, such a regulator is well-suited to supply a low-voltage regulated output to electronic systems which employ low voltage supplies in order to reduce power consumption and to employ small geometry devices.

DETAILED DESCRIPTION OF THE INVENTION

The new low drop-out voltage regulator controller, when combined with a pass transistor, produces an accurate, stable, temperature-compensated regulated output voltage from an unregulated input voltage. The single loop internally frequency compensated regulator relieves an end-user from the burden of compensating the regulator in the face of the vagaries of an ill-defined and variable load. The elegance of the single loop design reduces the number of components required to produce the new regulator controller, thus permitting the use of a larger pass transistor for a given package size. As a convenience, in the discussions which follow, unless otherwise noted, voltages will be referenced to COMMON so that, for example, "the voltage at VREG" refers to the voltage difference between the VREG and COMMON terminals.

Figure 3:
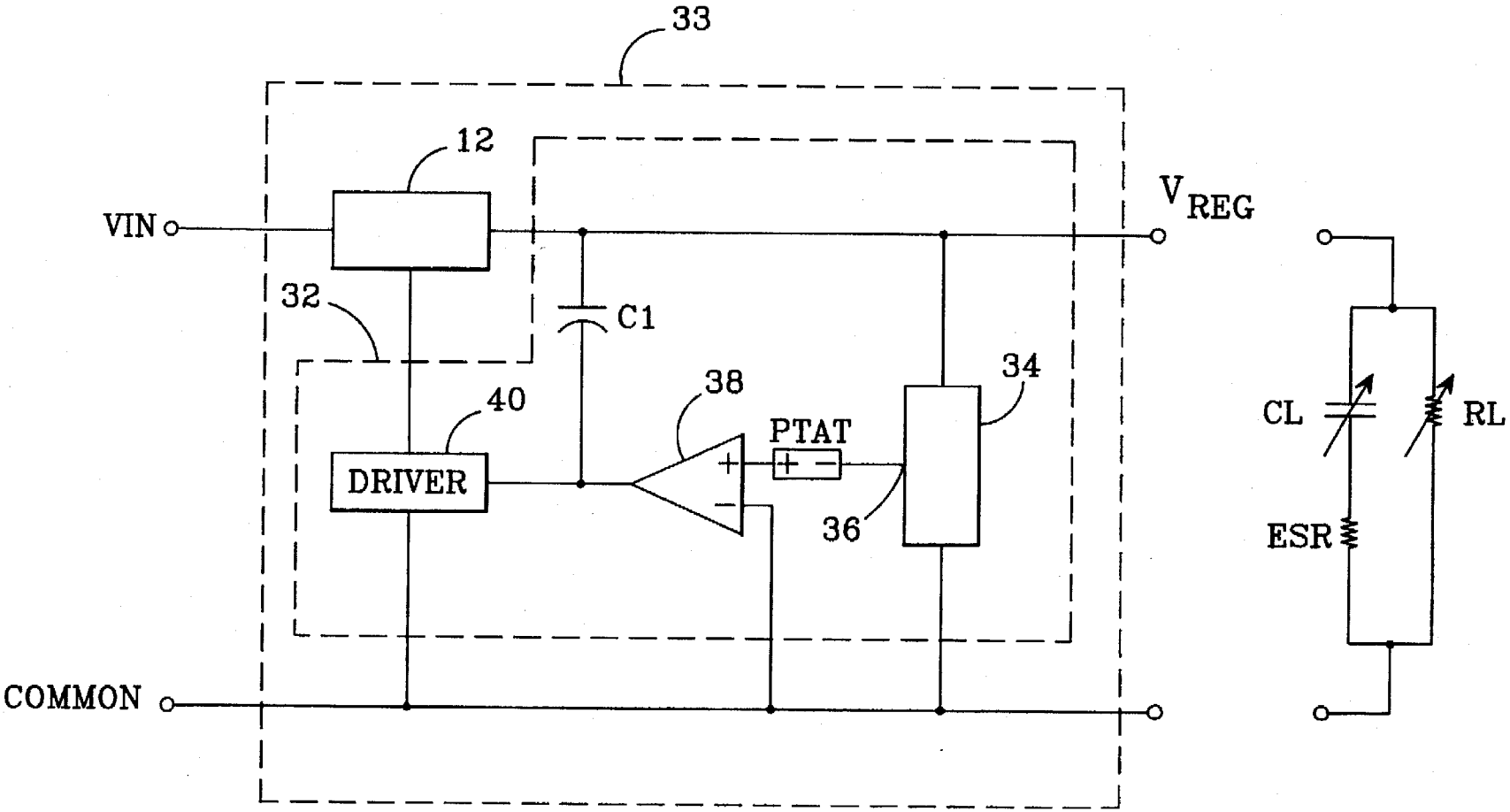
FIG. 3 is a block diagram of a new low dropout voltage regulator.

The block diagram of FIG. 3 depicts the major elements of the new voltage regulator controller 32. A pass transistor 12 may be added to the controller 32 to produce a new low drop-out voltage regulator 33. A feedback circuit 34 is connected across the VREG and COMMON terminals and produces a PTAT voltage at its tap 36 which is representative of the voltage at VREG. That is, the voltage at the tap 36 is proportional to both the voltage VREG and to the temperature of the controller. This tap is connected to the noninverting input of a high gain operational transconductance amplifier 38. As will be described in greater detail in relation to FIG. 5, the amplifier 38 features a common mode input range that includes its negative supply rail. This permits the connection of the inverting input to the negative supply rail, COMMON in the preferred embodiment, and, in turn, provides greater "headroom" for regulating relatively low output voltages. The amplifier also features an unbalanced differential input stage which produces a PTAT offset voltage, labeled PTAT, at its noninverting input. The utility of this offset voltage will become apparent from the discussion related to FIG. 4.

Figure 1:
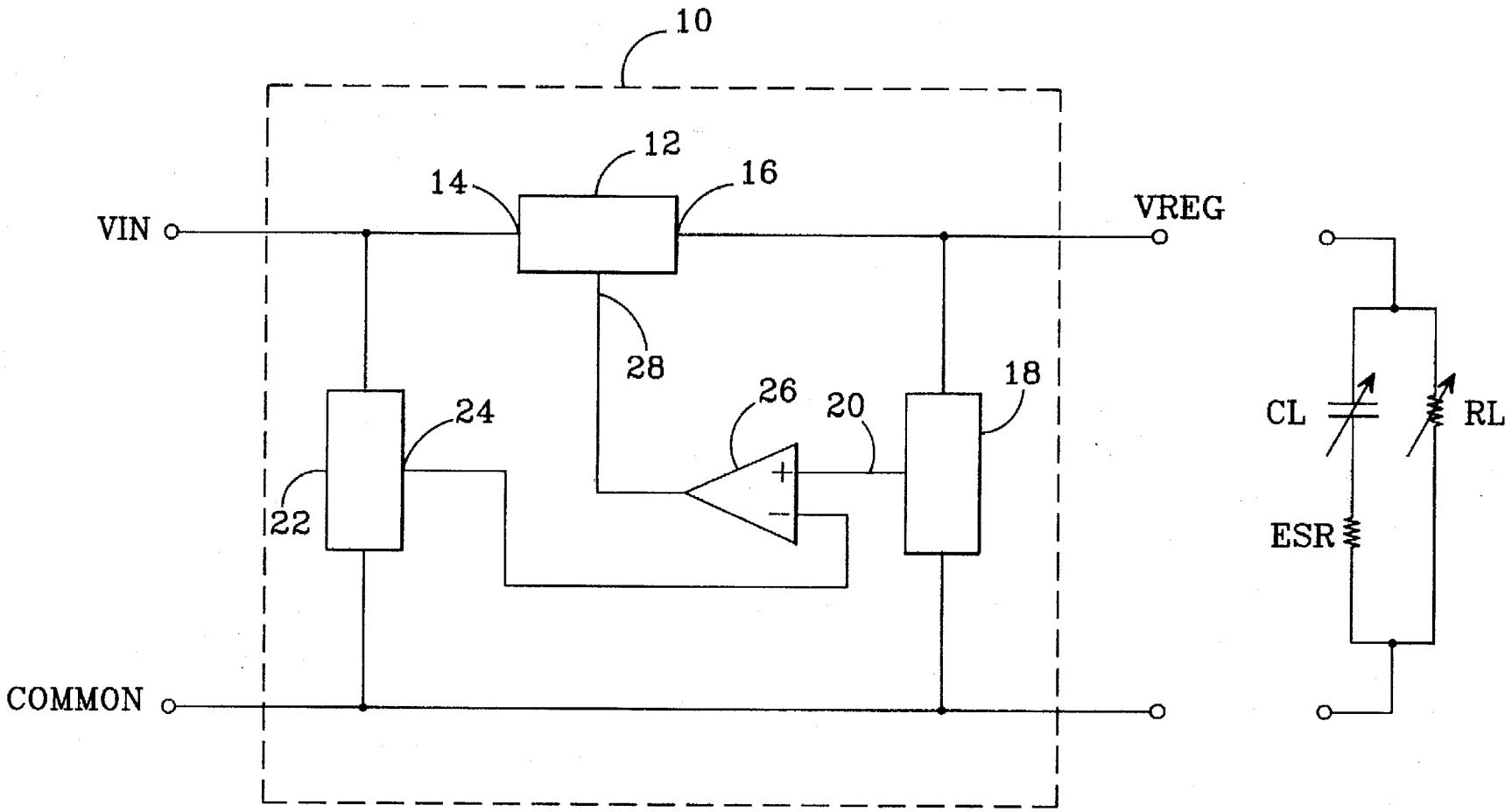
FIG. 1 (Prior Art)
FIG. 1 is a block diagram that illustrates the essential components of a conventional series voltage regulator.
Figure 2:
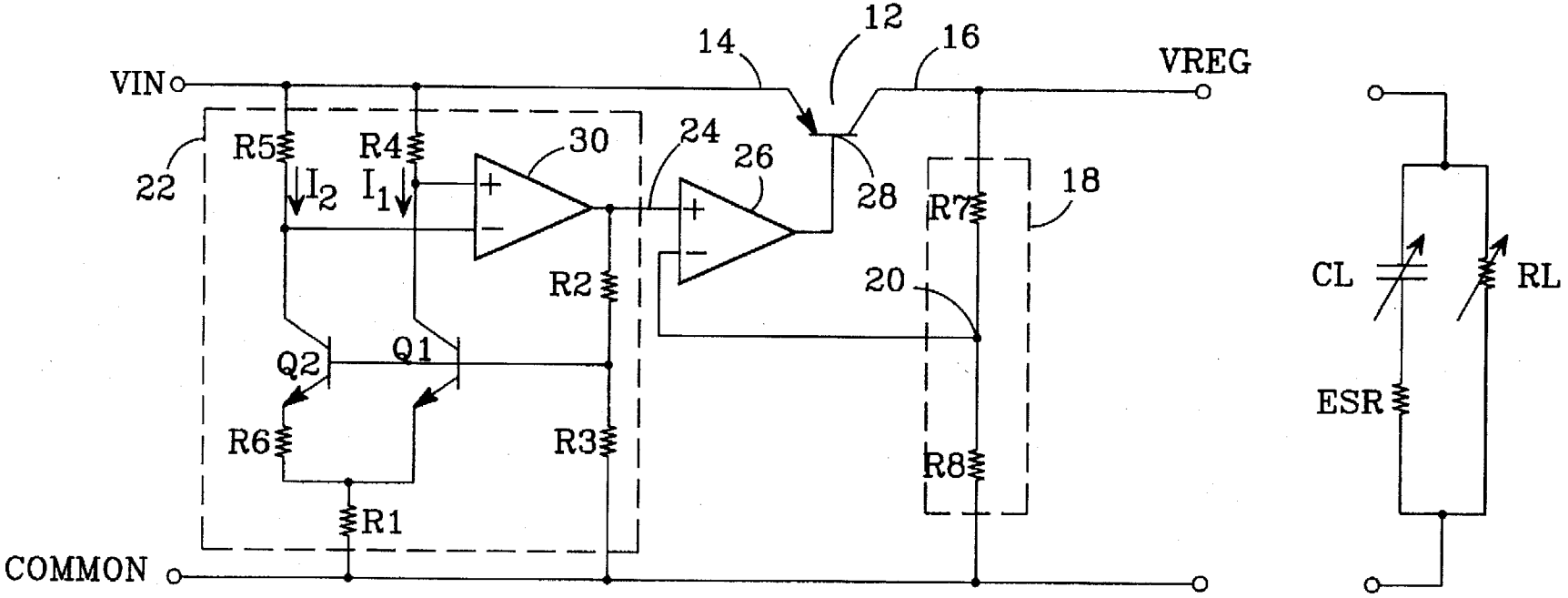
FIG. 2 (Prior Art)
FIG. 2 is a schematic diagram of a conventional low drop-out series regulator.

The output of the amplifier 38 is connected to a noninverting driver 40 which, in turn, is connected to drive a pass transistor 12. The noninverting driver facilitates internal frequency compensation of the regulator 33. The gain of the driver 40 is kept low to preserve its bandwidth, which must be high so that the poles of its frequency response are much higher than the main loop's unity gain frequency. For this reason, the amplifier 38 must provide sufficient gain, typically 20 dB more than required for a circuit such as illustrated in FIG. 2, to compensate for the attenuation of the feedback circuit 36.

A "pole-splitting" compensation capacitor C1 is connected from the output of the amplifier 38 to the output terminal VREG and ensures stability of the regulator 33, regardless of the value of load capacitance CL, load resistance RL, or effective series resistance ESR. The capacitor C1 effectively splits the regulator's poles so that the loop voltage gain rolls off and sets the regulator's unity gain frequency below the frequency associated with other system poles. For a detailed discussion of the use of pole splitting compensation capacitors see, James E. Solomon, *The Monolithic Op Amp: A Tutorial Study,* IEEE Journal of Solid State Circuits, Vol. SC-9, pp 314–332, Dec. 1974. The wideband noninverting driver 40 permits the connection of the compensation capacitor C1 between the regulator output and the output of the amplifier 38, thus rolling off the loop voltage gain at this point. The capacitor C1 is referred to the regulator output VREG, rather than COMMON in order to induce a response zero at unity gain from VREG to the output of the amplifier 38. A wide-band noninverting driver, and its application to the frequency compensation of a low dropout regulator, is disclosed in copending application Ser. No. 08/488,403 by the present inventor. Since the capacitor C1 is referred to the regulator output, it may be viewed as a pole splitting capacitor "around" the output stage, which consists of the noninverting driver 40 and the pass transistor 12. Viewed in this way, the capacitor C1 reduces the sensitivity of the loop response to the pole which results from the load capacitor CL. Consequently a relatively small, typically 0.47 μF, load capacitor CL is sufficient to roll off the gain of the output stage and ensure the regulator's stability.

Figure 4:
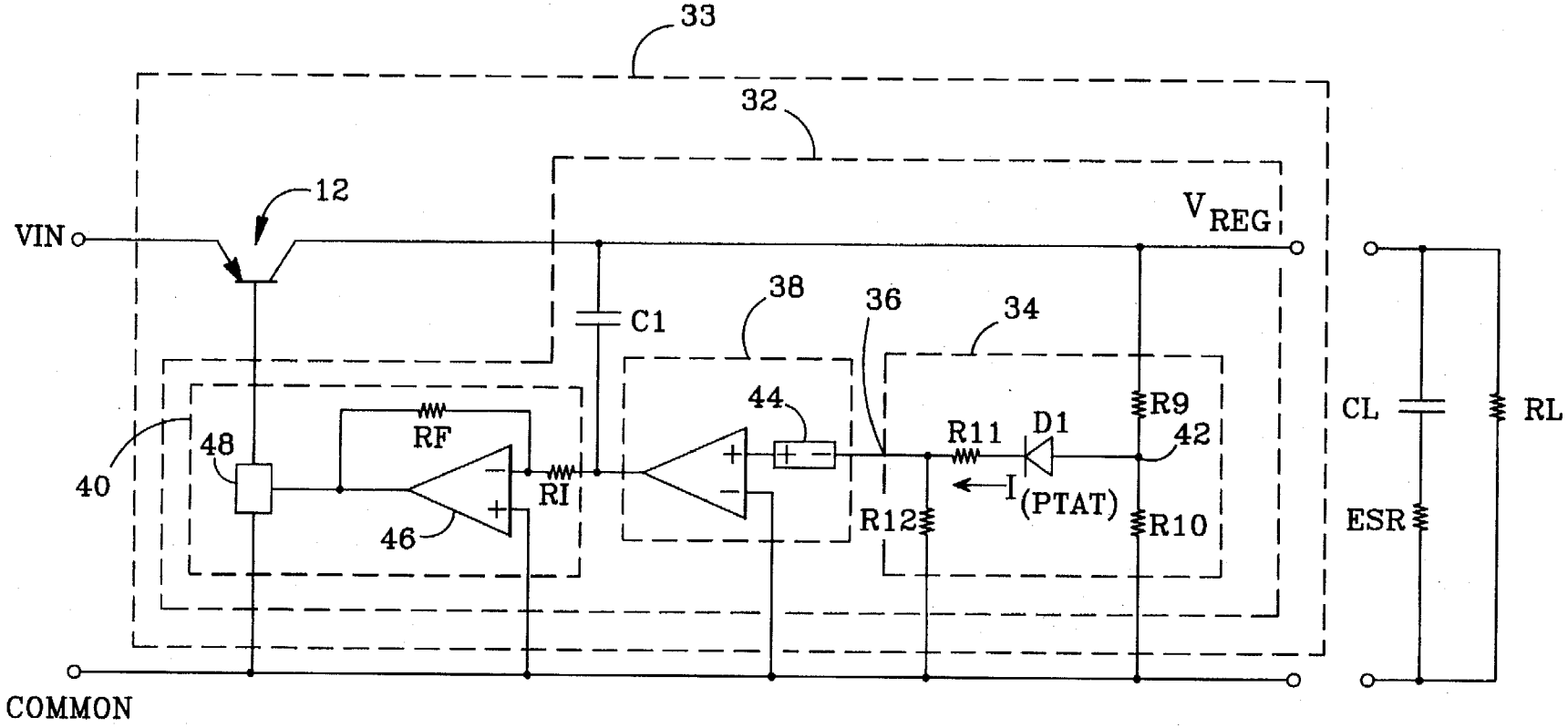
FIG. 4 is an expanded block diagram of the new low drop-out voltage regulator.

The schematic diagram of FIG. 4 provides a more detailed illustration of the voltage regulator controller 32 of FIG. 3. In this illustrative embodiment a PNP pass transistor 12 is combined with the controller 32 to form a voltage regulator 33, but as is known in the art, other transistors, in particular a p-channel FET, could be substituted for the PNP transistor. In the preferred embodiment, the feedback circuit 34 includes a voltage divider composed of resistors R9 and R10 connected across the VREG/COMMON terminals to provide at its tap 42 a measure of the regulated output voltage VREG. A diode D1 is connected at its anode to the divider tap 42 and at its cathode through a resistor divider R11/R12 to the COMMON terminal. The resistor R11 is connected at its other terminal, the tap 36, to the noninverting input of the amplifier 38.

The amplifier 38 is connected at its inverting input to COMMON and at its noninverting input to the output of the feedback circuit 36, i.e., the junction of resistors R11 and R12. The amplifier 38 includes a PTAT offset voltage 44 which, in this FIG., appears as an offset at its noninverting input. The amplifier 38 output is connected through a compensation capacitor C1 to the regulated output terminal VREG. The output of the amplifier 38 is also connected to the input of a noninverting driver 40.

The feedback circuit 34 employs resistors R9 and R10 in a ratio that would produce an open circuit voltage equal to the bandgap whenever the output of the regulator VREG is at the desired level, e.g., a 5 V regulator would require a ratio R9/R10=3/1. (Refer to the discussion related to FIG. 2 and to U.S. Patent U.S. Pat. No. 5,394,078 issued to the present applicant for more detailed description of bandgap references.) However, stead of using a separate amplifier to compare this node to an independently generated reference, as conventional regulators do, the new regulator 33 unifies the reference, feedback and amplifier functions.

That is, instead of employing a voltage reference 24, a feedback circuit 18 and a comparator 26 as conventional regulators do, (see, e.g., the discussion related to FIG. 2) the new regulator employs a feedback circuit 34 that incorporates a PTAT voltage output with the feedback voltage and combines this PTAT voltage with the PTAT input offset voltage of the amplifier 38 to produce a regulator control signal that is responsive to changes in the regulated output voltage VREG yet immune to variations in the regulator's temperature. This combination yields a significant reduction in complexity which, in turn, may significantly reduce the IC space required to produce the regulator controller 32 and permit the use of a larger pass transistor for a given package size.

As noted above, the resistors R9 and R10 are ratioed so that the open circuit voltage at their tap would be the bandgap voltage, approximately 1.25 V, whenever VREG equals the desired regulated output voltage. However, since the diode D1 loads the R9/R10 divider, the voltage appearing at the divider tap when VREG equals the desired output voltage will not equal the bandgap voltage. In fact, the output resistance of the R9/R10 divider, the resistances of the resistors R11 and R12, and the voltage drop across D1 are chosen so that a PTAT current flows through the resistor R12, establishing a PTAT voltage across the resistor R12 whenever the output voltage VREG equals the desired regulated value. The required PTAT current I(PTAT) is established by the amplifier 38, which adjusts the current through the pass transistor 12 so that the output voltage VREG is maintained at the desired value. Similar bandgap voltage reference circuits are disclosed in U.S. Pat. Nos. 4,902,959 and 5,394.078 issued to the present applicant.

Figure 7:
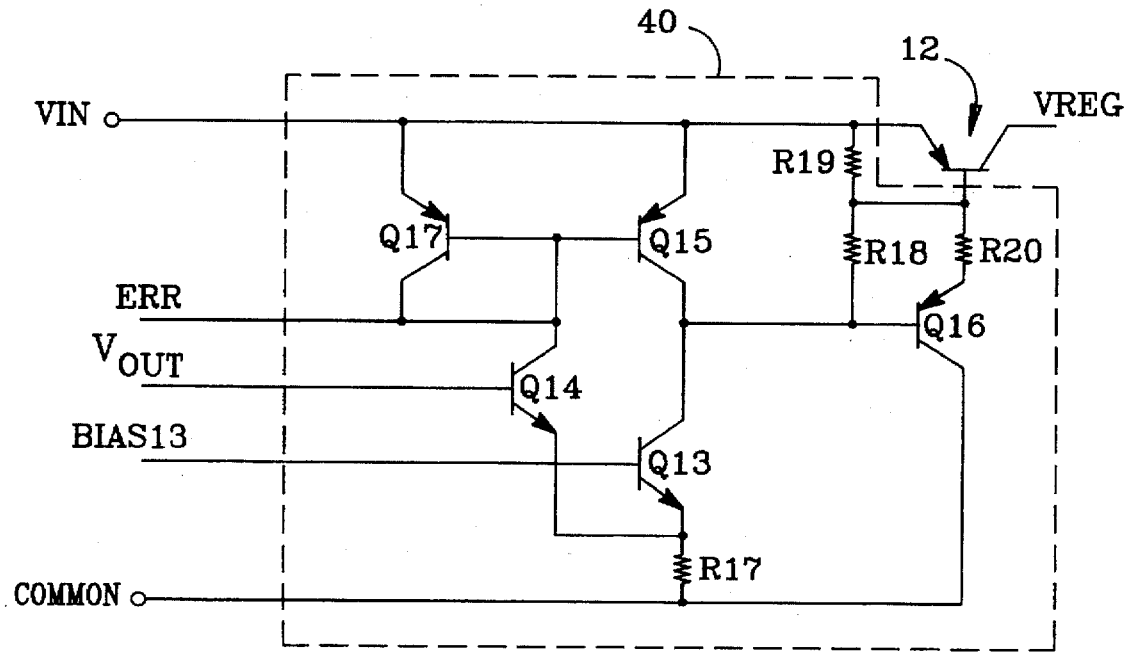
FIG. 7 is a schematic diagram of a preferred embodiment of the noninverting driver of FIG. 3.

In one embodiment, the noninverting driver includes an op amp 46 combined with input and feedback resistors, RI and RF respectively, to form an inverting amplifier. The output of the amplifier is connected to the control terminal of a driver transistor 48 which is connected at its current conducting terminals to the control terminal of the pass transistor 12 and to circuit COMMON. The driver transistor 48 inverts the signal from the inverting amplifier. This double inversion, i.e., that from the inverting amplifier and from the driver 48, yields an overall noninverting function from the driver 40. The gain of the noninverting driver 40 is kept low in order to preserve its bandwidth. To this end, in this embodiment the feedback and input resistors RF and RI, respectively, are equal valued resistors. Consequently the inverting amplifier is a unity gain amplifier. Other noninverting amplifier embodiments, specifically a preferred embodiment discussed in relation to FIG. 7, are possible.

Figure 5:
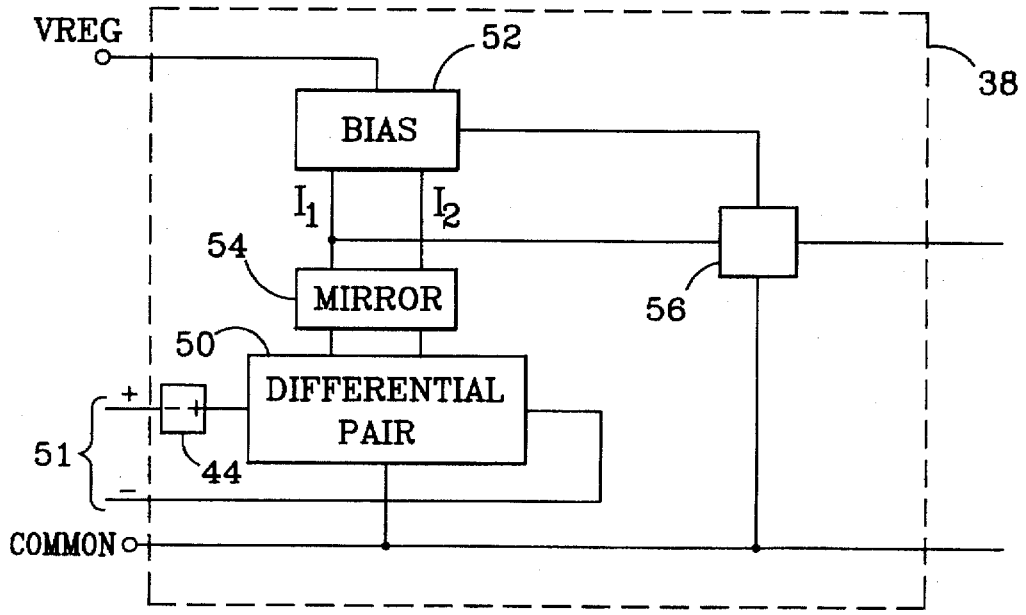
FIG. 5 is a block diagram of a preferred embodiment of the transconductance amplifier of FIG. 4.

The amplifier 38 is illustrated in greater detail in the block diagram of FIG. 5. An unbalanced differential pair of transistors 50 provide the inverting (–) and noninverting (+) inputs, i.e., differential input 51, to the amplifier. An imbalance in the differential pair creates a PTAT offset voltage 44 which, effectively, appears in series with the noninverting input lead. The unbalanced differential pair and their establishment of a PTAT offset voltage will be described in greater detail in relation to the discussion of FIG. 6. Equal valued currents I1 and I2 flow from a positive supply voltage, VREG in this example, through a bias circuit 52 to a current mirror 54 which provides a high impedance output from the differential pair 50 for the differential to single ended converter output stage 56. In addition to providing a PTAT offset and amplification, the differential pair accepts common mode input signals as low as the negative supply rail COMMON. As noted above, in the prefered embodiment of the controller 32, the noninverting input is connected to a feedback tap 36 and the inverting input is connected to COMMON.

Figure 6:
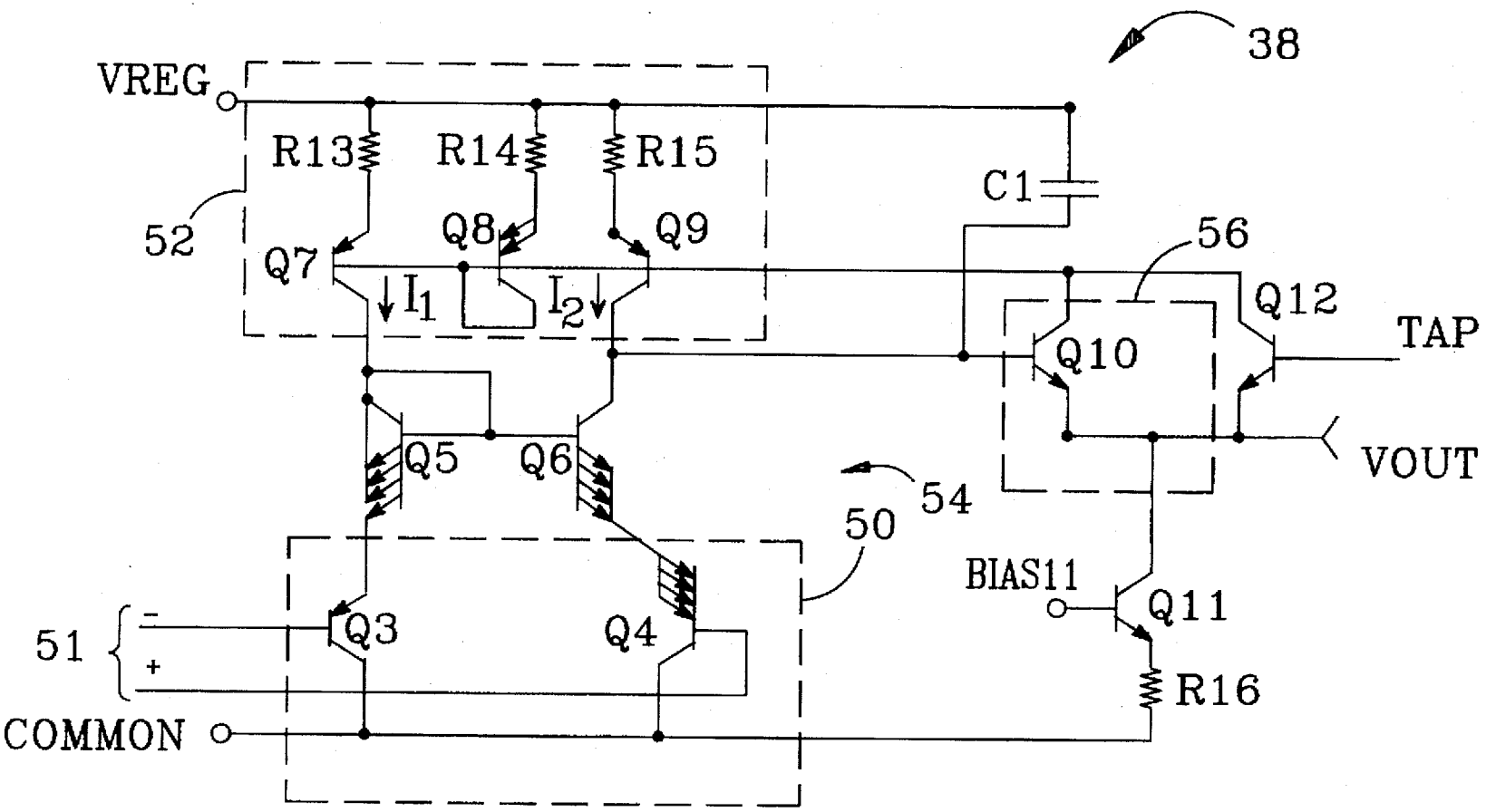
FIG. 6 is a schematic diagram of a preferred embodiment of the transconductance amplifier of FIG. 4.

In the preferred embodiment of FIG. 6 the amplifier 38 includes input PNP transistors Q3 and Q4, the bases of which provide the inverting (–) and noninverting (+) inputs, respectively, of the amplifier 38. Both transistors Q3 and Q4 have their collectors connected to COMMON. The emitter area of Q4 is four times that of Q3 and the emitters of Q3 and Q4 are connected to the similarly ratioed emitters of PNP transistors Q5 and Q6, respectively. The transistors Q5 and Q6 are connected as a ratioed current mirror 54, i.e., their bases are connected together and the transistor Q5 is diode-connected so that whatever value of current I1 flows into the collector of the transistor Q5 also flows, as current i2, into the transistor Q6. Three of the emitters from transistor Q5 are tied back to its base/collector to provide leakage compensation for the transistor Q6. PNP transistors Q7, Q8 and Q9 have their emitters connected, through resistors R13, R14 and R15, respectively, to the positive supply terminal VREG and supply bias currents to the differential pair 50 and the current mirror 54. The collectors of transistors Q7 and Q9 are connected to the collectors of Q5 and Q6 and thereby supply currents I1 and I2, respectively. The collector of the transistor Q6 is connected to drive the base of an output NPN transistor Q10 which produces a drive signal labeled VOUT.

The input transistors Q3 and Q4 drive transistors Q5 and Q6, effecting a differential stage which can sink currents I1 and I2. The diode connection of the transistor Q5 creates a low impedance point for sinking a current and providing drive current to the differential pair 50. The output of the differential pair, taken from the collector of transistor Q6 is responsive to the differential input voltage, i.e., the voltage across the inverting and noninverting terminals. Differential pairs are known. For a more detailed discussion of them see Paul Horowitz, Winfield Hill, *The Art of Electronics,* Cambridge University Press, 1989, pages 98–104. The four-to-one ratio of emitter areas exhibited by the transistors Q5 and Q6 and by the transistors Q3 and Q4 establishes a difference in the current densities of these transistors for equal valued-currents. This imposes the requirement that a differential input voltage be present across the differential input 51 in order for equal currents to flow through the emitters of Q3 and Q4. The value of this offset voltage VOS is given by the expression:

$$VOS=(kT/g)\ln[(4)(4)]$$

Where:

k=Boltzmann's constant

T=absolute temperature q=the electron charge

Any difference between the currents forced into the transistors Q5 and Q6 by the matched transistors Q7 and Q9 will correspondingly vary the drive presented to the base of the output transistor Q10. By placing unbalanced transistors in series in this fashion, an offset voltage proportional to the natural log of the product of the two ratios (16) is obtained. In contrast, to obtain such an offset from a single stage would require one transistor to have sixteen times the emitter area of the other, thus occupying more space. When the voltage at the noninverting input equals VOS, approximately 72 mV at room temperature, the base of the output transistor Q10 is driven to its neutral operating point, e.g., the base voltage which produces an output voltage VOUT at the emitter of Q10 equal to (VREG+COMMON)/2.

In the preferred embodiment, the transistors Q7 and Q9 are biased, by transistor Q12, to start the bias currents I1 and I2 as voltage VREG "ramps up" upon the application of power to the amplifier 38. The advantage of this arrangement over that of employing a fixed bias is that, with a fixed bias, any variation in the base current of the transistor Q10, supplied by the transistor Q9, or the combined base currents of the transistors Q6 and Q5, supplied by the transistor Q8, would be reflected back to the amplifier input as an undesirable offset voltage. In contrast, the preferred embodiment connects the bases of Q7, Q8 and Q9 to the collector of the output transistor Q10, thereby employing the collector current of the transistor Q10 to control the currents in the transistors Q7, QS, and Q9. In this way, the undesirable offset voltage may be reduced. In particular, the collector current of the transistor Q10 drives the transistor Q8 in a current mirror arrangement with transistors Q7 and Q9 so that the sum of their currents is approximately equal to the collector current of the transistor Q10.

Not only is the undesirable input offset voltage diminished by using the collector current to control the currents in transistors Q7 and Q9 as just described; this arrangement produces a substantial increase in the gain of the amplifier 38 when used in a closed loop application such as a low dropout voltage regulator. That is, because changes in the load (not shown) present at the amplifier output terminal VOUT are reflected back to both sides of the input differential pair (by changes in I1 and I2), the degree of input voltage change required to vary the base of the transistor Q10 is reduced; the gain is increased. Additionally, since the collectors of the transistors Q3 and Q4 are connected to COMMON, the common mode input range of the amplifier 38 includes COMMON. U.S. Pat. Nos. 5,394,078 and 5,406,222, issued to the present applicant, disclose amplifiers with input offsets and a common mode input range which includes a supply rail, such as COMMON in this exemplary embodiment.

The Q7–Q9 mirroring arrangement is degenerated by resistors R13–R15, respectively. Without this degeneration, the Q7 and Q9 transistors would have twice the transconductance of their associated halves, Q3/Q5 and Q4/Q6, respectively, of the input stage. Consequently, their noise would dominate the amplifier noise. The degeneration reduces the reflection of noise back to the input 51. An NPN transistor Q11, in combination with a resistor R16, provides a small bias current for the transistor Q10. A bias signal BIAS11 sets the NPN transistor Q11/resistor R16 combination to provide this small bias current and to provide additional bias current to other components of a regulator controller e.g., base current for the noninverting driver. The current established through the transistor Q10 in this fashion ensures that a minimum voltage appears across the degeneration resistors R13–R15.

In the preferred embodiment, an NPN transistor Q12 has its collector and emitter connected to the respective collector and emitter of the transistor Q10 and its base connected, in the regulator controller 32 application, to the junction of resistors R9 and R10, labeled TAP. The transistor Q12 ensures that the Q9/Q10 loop "starts up" when the voltage VREG increases upon powering the circuit up. During normal operation the emitter of the transistor Q12 is reverse-biased.

The frequency compensation capacitor C1 is connected between the base of Q10 and the VREG terminal, the common reference point for the current mirror. When employed within a regulator controller, the regulated output voltage will appear at the VREG terminal and high frequency components of the regulated output will be fed forward around the voltage gain stage to the base of Q10, thereby causing the regulator's frequency response to roll off at a desirable 6 dB per decade. The transistor Q10 acts as an emitter follower connected to drive the noninverting driver 40.

A preferred embodiment of the noninverting driver 40 is illustrated in the schematic diagram of FIG. 7. A bias signal BIAS13, produced by a combined bias and thermal shutdown circuit (not shown), supplies bias current to an NPN transistor Q13. In a voltage regulator application the positive supply voltage VIN would be regulated by the pass transistor 12 to produce the regulated output voltage VREG. An NPN transistor Q14 is connected at its base to a control signal labeled VOUT, thus forming the input to the noninverting driver 40. In a voltage regulator application, this would be the signal of the same name from the amplifier 38. The emitters of transistors Q14 and Q13 are coupled, through a resistor R17, to COMMON. The collector of the transistor Q13 is connected to the collector of a PNP transistor Q15 and to the base of another PNP transistor Q16, the drive transistor. A PNP transistor Q17 forms a current mirror with the PNP transistor Q15; the emitters of the transistors Q15 and Q17 are connected to the VIN terminal, their bases are connected together and the collector of the transistor Q17 is connected to its own base and to the collector of the input transistor Q14.

The transistor Q14 is driven at its base by the signal VOUT from the amplifier 38, and the Q17/Q15 current mirror along with the Q13/Q14 emitter coupled pair and the resistor R17 act as a current-steering circuit that provides drive current to the R18–R20/Q16 driver. The emitter of transistor Q14 "steals current" from the emitter of the transistor Q13, which forms a common emitter stage with the transistor Q14; since the base of the transistor Q13 has a fixed bias voltage, the transistor Q14 can regulate the fraction of current flowing through the resistor R17 that is supplied by the transistor Q13. With this current the transistor Q13 drives the pass transistor 12 through the network composed of resistors R18–R20 and the transistor Q16. In the preferred embodiment, the signal BIAS13, transistor Q13 and resistor R17 are selected to limit the CTAT current through Q13 to approximately 100 μA.

When the pass transistor 12 requires only a small base current, i.e., when a load attached to the regulator is relatively light, the current from the transistor Q13 passes through the resistor R18. That is, when small loads are attached to the regulator, the R18/Q13 combination provides sufficient base current for the pass transistor 12 to supply the necessary current to the load. Some current is required to overcome the base hold down resistor R19 and to thereby forward bias the pass transistor 12. Increased loads cause the amplifier 38 to decrease the drive VOUT, in turn forward biasing the transistor Q16. Once the transistor Q16 turns on in this fashion, any further increases in VOUT will be multiplied by the transistor Q16. The resistor R20 acts as a degeneration resistor, providing control over the amount of multiplication. Since the current through the transistor Q13 is CTAT and the maximum current available at the emitter of the transistor Q16 falls with increasing temperature (as the beta of the pass transistor Q12 rises), i.e.,it is also CTAT, the fraction of current used to forward bias the transistor Q16 remains relatively stable over temperature.

The current diverted from the emitter of the transistor Q13 by the transistor Q14 is reflected back into the collector of the transistor Q13 by the Q15/Q17 current mirror. This reflection ensures that the transistor Q13 operates well above the minimum current level required at light loads and thereby preserves the bandwidth of the driver 40. As the regulator's load increases, the collector current of the transistor Q14 will fall. At some point, the regulator's load current could be sufficient to cause the regulator to fall out of regulation and, for this reason, the collector of transistor Q14 is connected to an error circuit (not shown) through the terminal labeled ERR.

The forgoing description of specific embodiments of the invention has been presented for the purposes of illustration and description. It is not intended to be exhaustive or to limit the invention to the precise forms disclosed, and many modifications and variations are possible in light of the above teachings. Device types could be interchanged e.g., NPN transistors could be swapped for PNP transistors, with appropriate polarity exchanges for the circuits described, for example. The embodiments were chosen and described in order to best explain the principles of the invention and its practical application, to thereby enable others skilled in the art to best utilize the invention. It is intended that the scope of the invention be limited only by the claims appended hereto.

I claim:

1. A low dropout voltage regulator controller for connection with a pass transistor to produce a low dropout voltage regulator, comprising:

a common supply terminal, a control terminal connectable to the control terminal of a pass transistor, an unregulated voltage input terminal connectable to a current conducting terminal of a pass transistor, a regulated voltage output terminal connectable to another current conducting terminal of a pass transistor, a single-loop feedback controller connected between said regulated voltage output terminal and said pass transistor control terminal, said feedback controller including a transconductance amplifier having an output, said feedback controller connected to provide a control signal which, when connected to said pass transistor control terminal produces a regulated output voltage at said regulated voltage output terminal which is substantially independent of the regulator's load and operating temperature, and a pole-splitting compensation capacitor connected between the output of said transconductance amplifier and said regulated voltage output terminal which splits the regulator's poles to improve the stablilty of the regulator.

2. The controller of claim 1, wherein said single-loop feedback controller comprises:

a feedback circuit having a tap connected between said regulated output and common terminals, said circuit producing a proportional to absolute temperature (PTAT) signal, available at said tap, that is representative of the voltage at the regulated output terminal.

3. The controller of claim 2, wherein said single-loop feedback controller further comprises a differential input transconductance amplifier with a common mode input range that includes the common supply voltage, said amplifier further including a PTAT offset voltage at one of said inputs, said input being connected to the tap of the feedback circuit.

4. The controller of claim 3, wherein said single-loop feedback controller further comprises a non-inverting driver connected between the output of said amplifier and said pass transistor control terminal.

5. The controller of claim 4, wherein said single-loop feedback controller further comprises a compensation capacitor connected between said amplifier output and said regulated output terminal.

6. The controller of claim 5, wherein said amplifier comprises:

a differential input stage having inverting and noninverting inputs that accommodate common mode signals as low as its common supply voltage, said input stage connected to produce a PTAT input offset voltage, said inverting input connected to said common supply terminal and said output coupled to said pass transistor control terminal through said noninverting driver.

7. The controller of claim 6, wherein said differential input stage comprises:

a differential pair of PNP transistors having ratioed emitters, with their bases connected to provide said inverting and noninverting inputs, their collectors connected to said common supply terminal and their emitters connected to receive biasing currents.

8. The controller of claim 7, wherein said amplifier further comprises:

a ratioed current mirror connected to provide current to said differential pair and to amplify the PTAT offset voltage across said inverting and noninverting inputs.

9. The controller of claim 8, wherein said amplifier further comprises:

a bias circuit connected to provide bias current to said current mirror, and a differential to single-ended converter connected to convert an amplified differential signal from said differential pair into a single-ended signal and to modulate the current mirror bias current in response to variations in said amplified differential signal.

10. A low dropout voltage regulator having an unregulated voltage input terminal, a regulated voltage output terminal, and a common terminal, comprising:

a pass transistor having two current conducting terminals connected to said voltage input terminal, the other current conducting terminal connected to said regulated voltage output terminal, a single-loop feedback controller connected between said regulated voltage output terminal and said pass transistor control terminal, said controller including a transconductance amplifier having an output, said controller connected to provide a control signal which, when connected to said pass transistor control terminal produces a regulated output voltage which is substantially independent of the regulator's load and operating temperature, and a pole-splitting compensation capacitor connected between the output of said transconductance amplifier and said regulated voltage output terminal which splits the regulator's poles to improve the stability of the regulator.

11. The voltage regulator of claim 10, wherein said single-loop feedback controller comprises:

a feedback circuit having a tap connected between said regulated output and common terminals, said circuit producing a 5 PTAT signal, available at said tap, that is representative of the voltage at the regulated output terminal.

12. The regulator of claim 11, wherein said single-loop feedback controller further comprises a differential input transconductance amplifier with a common mode input range that includes the common supply voltage, said amplifier further including a proportional to absolute temperature offset voltage at one of said inputs, said input being connected to the tap of the feedback circuit.

13. The regulator of claim 12, wherein said single-loop feedback controller further comprises a non-inverting driver connected between the output of said amplifier and said pass transistor control terminal.

14. The regulator of claim 13, wherein said single-loop feedback controller further comprises a compensation capacitor connected between said amplifier output and said regulated output terminal.

15. The regulator of claim 14, wherein said amplifier comprises:

a differential input stage having inverting and noninverting inputs that accommodate common mode signals as low as its common supply voltage, said input stage connected to produce a PTAT input offset voltage, said inverting input connected to said common supply terminal and said output coupled to said pass transistor control terminal through said noninverting driver.

16. The regulator of claim 15, wherein said differential input stage comprises:

a differential pair of PNP transistors having ratioed emitters, with their bases connected to provide said inverting and noninverting inputs, their collectors connected to said common supply terminal and their emitters connected to receive biasing currents.

17. The regulator of claim 16, wherein said amplifier further comprises:

a ratioed current mirror connected to provide current to said differential pair and to amplify the PTAT offset voltage across said inverting and noninverting inputs.

18. The regulator of claim 17, wherein said amplifier further comprises:

a bias circuit connected to provide bias current to said current mirror, and a differential to single-ended converter connected to convert an amplified differential signal from said differential pair into a single-ended signal and to modulate the current mirror bias current in response to variations in said amplified differential signal.

19. A low dropout voltage regulator having an unregulated voltage input terminal, a regulated voltage output terminal, and a common terminal, comprising:

a pass transistor having two current conducting terminals and one control terminal, one of said current conducting terminals connected to accept an unregulated input voltage, the other current conducting terminal connected to provide said regulated voltage output, a noninverting driver connected to drive said control terminal of said pass transistor, a differential amplifier having inverting and non-inverting inputs and an output, said amplifier being connected at its inverting input to a negative voltage supply and at its output to said control terminal of the pass transistor through said noninverting driver, and an input stage that accommodates common mode signals as low as the amplifier's negative supply rail, said input stage also connected to produce a PTAT input offset voltage, a feedback circuit connected to sense the voltage across said regulated voltage output terminal and said common terminal and to provide at a tap terminal a PTAT signal that is representative of said voltage across said regulated voltage output and common terminals, said tap terminal connected to the noninverting input of said amplifier, and a compensation capacitor connected from the output of said amplifier to said regulated voltage output terminal.

20. The voltage regulator of claim 19, wherein said amplifier comprises:

a differential pair of bipolar transistors having ratioed emitters, said transistors connected to produce a PTAT offset voltage across said inverting and noninverting inputs.

21. The voltage regulator of claim 20, wherein said amplifier further comprises:

a ratioed current mirror connected to provide current to said differential pair and to amplify the PTAT offset voltage across said inverting and noninverting inputs.

22. The voltage regulator of claim 21, wherein said amplifier further comprises:

a bias circuit connected to provide bias current to said current mirror, and a differential to single-ended converter connected to convert an amplified differential signal from said differential pair into a single-ended signal and to modulate the bias current in response to variations in said amplified differential signal.

23. The voltage regulator of claim 22, wherein said noninverting driver comprises:

a low-gain, wide-band amplifier.

24. The voltage regulator of claim 23, wherein said noninverting driver comprises:

a unity gain inverting amplifier connected to be driven by said differential amplifier, and a drive transistor having two current conducting terminals and a control terminal, one of said drive transistor current conducting terminals coupled to the negative voltage terminal, the other current conducting terminal coupled to the control terminal of said pass transistor, and the control terminal of said drive transistor connected to be driven by the unity gain inverting amplifier.

25. The voltage regulator of claim 23, wherein said noninverting driver comprises:

a drive transistor having two current conducting terminals and a control terminal, the control terminal coupled to be driven by said differential to single ended converter, one of said drive transistor current conducting terminals coupled to the negative supply terminal, and the other current conducting terminal coupled to the control terminal of said pass transistor, said drive transistor connected to produce a voltage swing at the control terminal of said pass transistor which is in phase with the voltage swing of the differential to single-ended converter.

26. The voltage regulator of claim 25, wherein said driver further comprises:

a resistor network connected to provide starter current for said pass transistor and a current steering circuit connected to modulate the control terminal of said drive transistor in phase with the signal from the differential to single-ended converter.

27. The voltage regulator of claim 25, wherein said drive transistor is a PNP transistor with its emitter coupled to the control terminal of said pass transistor.

28. The voltage regulator of claim 25, wherein said drive transistor is a p-channel FET.

29. The voltage regulator of claim 25, wherein said feedback circuit comprises:

a first voltage divider having a tap connected connected across said regulated output and negative supply terminals, a diode connected at its anode to the tap of said first voltage divider, and a second voltage divider connected between the cathode of said diode and said negative supply terminal, and at its tap to said noninverting input of said amplifier.

30. The voltage regulator of claim 29, wherein said first voltage divider is ratioed to produce an open circuit voltage equal to the bandgap voltage at its tap whenever the voltage at the regulated output terminal equals a prescribed value.

* * * * *